US011024254B2

(12) United States Patent
Wang et al.

(10) Patent No.: US 11,024,254 B2
(45) Date of Patent: Jun. 1, 2021

(54) DISPLAY CONTROL SYSTEM AND DISPLAY APPARATUS

(71) Applicant: BOE TECHNOLOGY GROUP CO., LTD., Beijing (CN)

(72) Inventors: Shu Wang, Beijing (CN); Rao Hui, Beijing (CN); Zhiguo Zhang, Beijing (CN); Xin Li, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/978,857

(22) PCT Filed: Jan. 10, 2020

(86) PCT No.: PCT/CN2020/071516
§ 371 (c)(1),
(2) Date: Sep. 8, 2020

(87) PCT Pub. No.: WO2020/143794
PCT Pub. Date: Jul. 16, 2020

(65) Prior Publication Data

US 2021/0056928 A1 Feb. 25, 2021

(30) Foreign Application Priority Data

Jan. 11, 2019 (CN) ..... 201920047245.8

(51) Int. Cl.
*G09G 5/00* (2006.01)

(52) U.S. Cl.
CPC ..... *G09G 5/006* (2013.01); *G09G 2330/02* (2013.01); *G09G 2370/12* (2013.01); *G09G 2370/16* (2013.01)

(58) Field of Classification Search
CPC ..... G09G 5/006; G09G 3/20; G09G 2370/16; G09G 2330/02; G09G 2370/12; G09F 9/00
See application file for complete search history.

(56) References Cited

U.S. PATENT DOCUMENTS 9,881,536 B2 1/2018 Nejat et al.
2014/0218627 A1* 8/2014 Wu ..... H04N 5/655 348/839

(Continued)

FOREIGN PATENT DOCUMENTS

CN 202075965 U 12/2011
CN 202110536 U 1/2012

(Continued)

*Primary Examiner* — Abbas I Abdulselam
(74) *Attorney, Agent, or Firm* — Dilworth & Barrese, LLP.; Michael J. Musella, Esq.

(57) ABSTRACT

A display control system and a display apparatus are disclosed. The display control system includes a circuit board including a top edge, a bottom edge opposite to the top edge and a side edge intersecting with the top edge and the bottom edge, a length of the top edge and a length of the bottom edge being larger than that of the side edge; a core module on the circuit board for processing display information; an image data output interface on the circuit board, connected with the core module for outputting display image data; a plurality of function modules on the circuit board, connected with the core module for transmitting the display information to the core module. The function modules and the core module are along the top edge, and the image data output interface is on a side of the function modules close to the bottom edge.

20 Claims, 9 Drawing Sheets

(56) References Cited

U.S. PATENT DOCUMENTS

| | | | | |
|---|---|---|---|---|
| 2018/0267661 | A1 | 9/2018 | Suzuki | |
| 2019/0304388 | A1* | 10/2019 | Chen | G09G 3/2092 |

FOREIGN PATENT DOCUMENTS

| | | | |
|---|---|---|---|
| CN | 102457686 | A | 5/2012 |
| CN | 209118662 | U | 7/2019 |

* cited by examiner

DISPLAY CONTROL SYSTEM AND DISPLAY APPARATUS

The present application claims priority to Chinese patent application No. 201920047245.8, filed on Jan. 11, 2019, the entire disclosure of which is incorporated herein by reference as part of the present application.

TECHNICAL FIELD

At least one embodiment of the present disclosure relates to a display control system and a display apparatus.

BACKGROUND

With the development of display technology and the popularization of applications of display technology, disposing a strip display screen on a shelf in a supermarket have become a special application scene of display apparatuses.

A display panel is provided with a system on chip (SOC) as a driving module. The size and the structure of the traditional SOC are designed for the existing display panel. Based on the application scene of installing the strip display screen on the shelf in the supermarket, the structure of the strip display screen is relatively special, and the size and the length-width ratio are quite different from the existing display panel. The size is 542.4 millimeters (mm)*52.7 mm Therefore, the traditional SOC is difficult to meet the installation requirements of the strip display screen.

SUMMARY

At least one embodiment of the present disclosure provides a display control system, the display control system comprises: a circuit board, a core module, an image data output interface and a plurality of function modules. The circuit board comprises a top edge, a bottom edge opposite to the top edge, and a side edge intersecting with the top edge and the bottom edge; both a length of the top edge and a length of the bottom edge are larger than a length of the side edge; a core module disposed on the circuit board and configured to process display information; an image data output interface on the circuit board, connected with the core module, and configured to output display image data; the plurality of function modules on the circuit board, connected with the core module, and configured to transmit the display information to the core module; the plurality of function modules and the core module are arranged along an extension direction of the top edge, and the image data output interface is on a side, close to the bottom edge, of the plurality of function modules.

For example, in the display control system provided by at least one embodiment, a width of the core module in an extension direction of the side edge is larger than a width of each function module of the plurality of function modules in the extension direction of the side edge; along the extension direction of the top edge, the core module is on a side of the plurality of function modules, and the image data output interface is on a side, close to the plurality of function modules, of the core module, or, along the extension direction of the top edge, the core module is between any two adjacent function modules of the plurality of function modules, and the image data output interface is on a side of the core module.

For example, in the display control system provided by at least one embodiment, no module is between the bottom edge and an edge, close to the bottom edge, of the image data output interface.

For example, in the display control system provided by at least one embodiment, the plurality of function modules comprise: an image transmission network module, a guide module, and a program burning module; the image transmission network module configured to transmit image information to the core module; the guide module configured to guide the core module to read data; and the program burning module configured to load an operation system to the core module.

For example, the display control system provided by at least one embodiment further comprises a wireless fidelity (WIFI) module on a side, close to the bottom, of at least a part of function modules of the plurality of function modules edge, and comprising an antenna terminal; the antenna terminal is close to the bottom edge.

For example, in the display control system provided by at least one embodiment, the side edge comprises a first side edge and a second side edge which are opposite to each other, and the display control system further comprises: an interface which is arranged along at least one selected from a group consisting of the first side edge and the second side edge and comprises at least one selected from a group consisting of a voltage interface, a serial peripheral interface (SPI), an internal integrated circuit bus (IIC) interface, a serial interface and a universal serial bus (USB) interface.

For example, in the display control system provided by at least one embodiment, the USB interface comprises at least one selected from a group consisting of a USB On-The-Go (USB OTG) and a USB HOST.

For example, the display control system provided by at least one embodiment comprises a plurality of voltage interfaces; the voltage interfaces are arranged along both the first side edge and the second side edge, and at least one selected from a group consisting of the SPI interface and the IIC interface is arranged along both the first side edge and the second side edge.

For example, in the display control system provided by at least one embodiment, the voltage interface, the SPI, the IIC interface and the serial interface are sequentially arranged along the first side edge of the circuit board, and the USB OTG, the USB HOST, the SPI and the voltage interface are sequentially arranged along the second side edge of the circuit board.

For example, in the display control system provided by at least one embodiment, the interfaces satisfy one or more of the following modes: all the voltage interface, the SPI, the IIC interface and the serial interface adopt horizontal patch pin header; and the serial interface is in a transistor-transistor logic (TTL) mode.

For example, in the display control system provided by at least one embodiment, the core module comprises a core circuit; the image transmission network module comprises an Ethernet circuit, and the guide module comprises a guide circuit.

For example, in the display control system provided by at least one embodiment, the plurality of function modules further comprise: a power module, and the power module is configured to supply power for the display control system; and the display control system further comprises: a power interface and an Ethernet interface; the power interface is between the power module and the bottom edge of the circuit board; and the Ethernet interface is between the Ethernet circuit and the bottom edge of the circuit board, wherein no module is between the power interface and the bottom edge of the circuit board, and no module is between the Ethernet interface and the bottom edge of the circuit board.

For example, in the display control system provided by at least one embodiment, the power interface and the Ethernet interface are upright interfaces.

For example, in the display control system provided by at least one embodiment, the power module and the Ethernet circuit are adjacent to each other, and the display control system comprises: one of a controller area network (CAN) bus interface and a power over Ethernet (POE) interface which is disposed between the power module and the Ethernet circuit and the bottom edge of the circuit board and is connected with the power module and the Ethernet circuit; no module is arranged between the CAN bus interface and the bottom edge of the circuit board or no module is arranged between the POE interface and the bottom edge of the circuit board.

For example, the display control system provided by at least one embodiment further comprises: at least one selected from a group consisting of a near field communication (NFC) module, an analog-to-digital conversion (ADC) module and a high definition multimedia interface (HDMI), arranged along the extension direction of the top edge with the plurality of function modules.

For example, in the display control system provided by at least one embodiment, along the extension direction of the top edge, the power module, the Ethernet circuit, the guide module, the program burning module, the HDMI and the core module are sequentially arranged, the image data output interface is between the WIFI module and the core module, and the WIFI module is between the guide circuit and the bottom edge of the circuit board.

For example, in the display control system provided by at least one embodiment, a center line of a length of the image data output interface in the extension direction of the top edge overlaps with a center line of the top edge, or, the center line of the length of the image data output interface in the extension direction of the top edge is within a deviation threshold away from the center line of the top edge on two sides of the center line of the top edge along the extension direction of the top edge.

For example, in the display control system provided by at least one embodiment, a length of the top edge is eight times the length of the side edge.

At least one embodiment of the present disclosure provides a display apparatus, and the display apparatus comprises a strip display screen and the display control system provided by the embodiment of the disclosure. The trip display screen comprises an image data input interface; the display control system is on a non-display side of the strip display screen, and the image data output interface of the display control system is connected with an image data input interface of the strip display screen.

For example, in the display apparatus provided by at least one embodiment, an orthographic projection of a center of the image data output interface of the display control system on the circuit board coincides with an orthographic projection of a center of the image data input interface of the strip display screen on the circuit board.

For example, in the display apparatus provided by at least one embodiment, the orthographic projection of the image data output interface of the display control system is overlapped with the orthographic projection of the image data input interface of the strip display screen.

For example, in the display apparatus provided by at least one embodiment, the image data output interface of the display control system is connected to the image data input interface of the display through a flexible printed circuit (FPC) cable.

For example, in the display apparatus provided by at least one embodiment, the strip display screen possesses a side edge extending along an extension direction of the side edge and comprises function modules arranged along the side edge of the strip display screen; and in the case where the display control system comprises a voltage interface and a serial peripheral interface (SPI), the display control system is connected to the function modules of the strip display screen through the voltage interface and the SPI.

BRIEF DESCRIPTION OF THE DRAWINGS

In order to clearly illustrate the technical solutions of the embodiments of the disclosure, the drawings of the embodiments will be briefly described in the following; it is obvious that the described drawings are only related to some embodiments of the disclosure and thus are not limitative to the disclosure.

DETAILED DESCRIPTION

Figure 1:
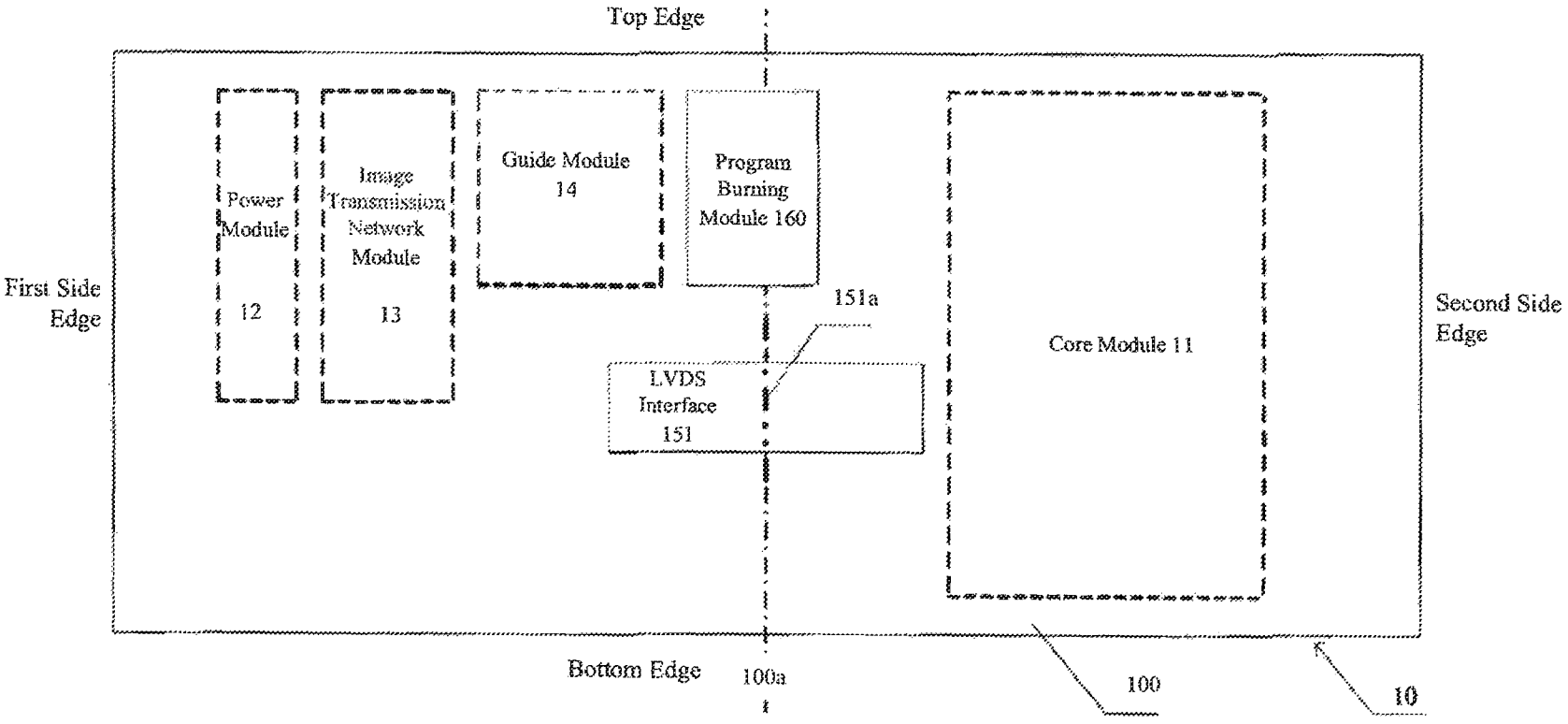
FIG. 1 is a schematic structural view of a display control system provided by an embodiment of the present disclosure.

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive operation, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to indicate any sequence, amount or importance, but distinguish various components. Also, the terms "comprise," "comprising," "include," "including," etc., are intended to specify that the elements or the objects stated before these terms encompass the elements or the objects and equivalents thereof listed after these terms, but do not preclude the other elements or objects. "On," "under," "inside," "outside," and the like are only used to indicate relative position relationship, and when the absolute position of the object which is described is changed, the relative position relationship may be changed accordingly.

In order to make the objectives, technical solutions, and advantages of the present disclosure clearer, the embodiments of the present disclosure are described in detail below with reference to the accompanying drawings. It should be noted that the embodiments in the present application and the characteristics in the embodiments can be combined with each other arbitrarily without conflict.

The steps illustrated in the flowcharts of the drawings may be executed in a computer system of, e.g., a set of computer-executable instructions. Moreover, although the logical sequence is illustrated in the flowchart, in some cases, the illustrated or described steps can be performed in an order different than the order here.

The following specific embodiments of the present disclosure can be combined with each other, and the same or similar concepts or processes may not be repeated in some embodiments.

The traditional display control system such as the SOC is a driving device designed for the existing display panel. The size and the structure of the existing display panel are usually relatively fixed, for example, a liquid crystal display (LCD) panel with a length-width ratio of 16:9, or a display panel with other sizes. However, the size and the structure of the strip display screen installed on the supermarket shelf is required to have large difference from the existing display panel, for example, the above 542.4 mm*52.7 mm display panel. Because of the special structure of the strip display screen, the size and the structure of the traditional SOC are difficult to satisfy the requirement of being installed on the strip display screen. Therefore, it is required to design a display control system with a special structure so that the display control system can be adapted to the structure of the strip display screen and can satisfy the installation requirements of the strip display screen.

At least one embodiment of the present disclosure provides a display control system, the display control system comprises: a circuit board, a core module, an image data output interface and a plurality of function modules. The circuit board comprises a top edge, a bottom edge opposite to the top edge, and a side edge intersecting with the top edge and the bottom edge; both a length of the top edge and a length of the bottom edge are larger than a length of the side edge; a core module disposed on the circuit board and configured to process display information; an image data output interface on the circuit board, connected with the core module, and configured to output display image data; the plurality of function modules on the circuit board, connected with the core module, and configured to transmit the display information to the core module; the plurality of function modules and the core module are arranged along an extension direction of the top edge, and the image data output interface is on a side, close to the bottom edge, of the plurality of function modules.

FIG. 1 is a schematic structural view of a display control system provided by an embodiment of the present disclosure. The embodiment of the present disclosure takes the case that the display control system is an SOC as an example. As illustrated in FIG. 1, the SOC 10 provided by the embodiment comprises: a circuit board 100, a core module 11, an image data output interface 151 and a plurality of function modules. The circuit board 100 includes a top edge, a bottom edge opposite to the top edge, and a side edge intersecting with the top edge and the bottom edge. Both the length of the top edge and the length of the bottom edge are larger than the length of the side edge. For example, the length of the top edge is larger than or equal to eight times the length of the side edge. For example, the side edges of the circuit board 100 includes a first side edge and a second side edge opposite to the first side edge. Both the length of the top edge and the length of the bottom edge are larger than or equal to eight times the length of the first side and larger than or equal to eight times the length of the second side edge. The core module 11 is disposed on the circuit board 100 and is configured to process display information. The image data output interface 151 is disposed on the circuit board 100, connected with the core module 11, and configured to output display image data. The plurality of function modules are disposed on the circuit board 100, connected with the core module 11, and configured to transmit the display information to the core module. For example, the plurality of function modules include: a power module 12, an image transmission network module 13, a guide module 14 and a program burning module 160. The plurality of function modules are all in signal connection with the core module 11, for example, in wired signal connection or wireless signal connection. The power module 12 is configured to provide power for the display control system. The image transmission network module 13 is configured to transmit image information to the core module 11. The guide module 14 is configured to guide the core module 11 to read data. The program burning module 160 is configured to load an operation system to the core module 11. The plurality of function modules, e.g., the power module 12, the image transmission network module 13, the guide module 14 and the program burning module 160, and the core module 11 are arranged along the extension direction of the top edge, and the image data transmission interface 151 is disposed on a side, close to the bottom edge, of the plurality of function modules. Thus, the plurality of function modules and the core module 11 are all arranged along a same longer edge of the circuit board 100, which is favorable for forming the SOC in a strip shape. Meanwhile, a blank region is disposed on a side, close to the bottom edge, of the plurality of function modules. Thus, the image data output interface 151 is disposed in the blank area, so as to realize reasonable and sufficient utilization of the space of the circuit board in the strip shape.

It should be noted that in some other embodiments of the present disclosure, the display control system may not comprise the power module 12 and may adopt an external power source.

The SOC 10 provided by at least one embodiment of the present disclosure may be mounted on the back of the strip display screen. The strip display screen is, for example, a display mounted on a supermarket shelf, and may also be a display in a strip shape mounted on other shelves. The SOC 10 provided by at least one embodiment of the present disclosure adopts a reasonable layout of circuits, modules and interfaces in the circuit board 100, can realize the requirement that the length of the display in the strip shape is much larger than the width, thus can realize good adapting effect with the structure of the strip display screen, achieve the effect of the reasonable combination of the whole strip display screen, and solve the problem that the size and the structure of the traditional SOC are difficult to satisfy the requirement of mounting the SOC on the strip display screen because of the special structure of the strip display screen.

In actual application, the image data output interface 151 arranged on the circuit board 100 may be a low voltage differential signaling (LVDS) interface 151. The following embodiments and the accompanying drawings of the present disclosure are all illustrated by taking the case that the image data output interface is the LVDS interface 151 as an example. Correspondingly, the image data input interface arranged on the strip display screen is also an LVDS interface. Of course, in other embodiments, the image data output interface 151 may also be other types of interfaces, e.g., a high definition multimedia interface (HDMI) interface. Correspondingly, the image data input interface arranged on the strip display screen is also an HDMI interface. The specific type of the LVDS interface 151 is not limited in the embodiments of the present disclosure. In the case where the SOC 10 is mounted on the strip display screen, the LVDS interface 151 on the circuit board 100 is required to be connected with the LVDS interface in the strip display screen, so as to transmit display image data from the core module 11 to the display through the LVDS interface in the strip display screen. Thus, the position of the LVDS interface 151 on the circuit board 100 is in corresponds to the position of the LVDS interface in the strip display screen.

For example, the planar shape of the circuit board is rectangle; the top edge is parallel to the bottom edge; and the first side edge is parallel to the second side edge.

For example, as illustrated in FIG. 1, a width of the core module 11 in the extension direction of the side edge (the first side edge or the second side edge) is larger than a width of each of the plurality of function modules in the extension direction of the side edge. Along the extension direction of the top edge, the core module 11 is disposed on a side of all the plurality of function modules, and the image data output interface 151 is disposed on a side, close to the plurality of function modules, of the core module 11, so the image data output interface 151 is close to the core module 11 and is disposed in the blank area between the plurality of function modules and the bottom edge, and then the space of the circuit board 100 is reasonably utilized. Or in another embodiment, along the extension direction of the top edge, the core module 11 is disposed between any two adjacent function modules of the plurality of function modules, for example, disposed between the guide module 14 and the program burning module 160, and the image data output interface 151 is disposed on a side of the core module 11 in the extension direction of the top edge, which can also achieve the effect similar to that of the embodiment as illustrated in FIG. 1.

For example, no assembly is disposed between the image data output interface 151 and the core module 11, so as to realize the connection between the image data output interface 151 and the core module 11. The assembly here includes but not limited to interface, circuit, device, module, etc.

The distance from the LVDS interface 151 to the top edge and the bottom edge may be adjusted according to the size and the layout of interfaces and devices on the periphery thereof. For example, no assembly is disposed between an edge, close to the bottom edge, of the image data output interface 151 and the bottom edge. A connection line for connecting the LVDS interface 151 and the image data input interface of the strip display screen is disposed in the blank area, which can, on one hand, realize the arrangement of the connection line and realize the connection of the LVDS interface 151 and the image data input interface, and on the other hand, can avoid the signal interference of other modules in this area. The assembly here includes but is not limited to interface, circuit, device, module, etc.

In a possible implementation of the embodiment of the present disclosure, the LVDS interface 151 in the SOC 10 may be disposed at the center of the entire circuit board 100 in the extension direction of the top edge. For example, a center line of the length of the image data output interface 151 in the extension direction of the top edge overlaps with a center line of the top edge. That is to say, the center lines 151*a*, in the direction from left to right, of the LVDS interface 151 of the SOC 10 overlaps with the center line 100*a*, in the direction from left to right, of the circuit board 100 (as illustrated in FIG. 1, 151*a* overlaps with 100*a*).

Figure 2:
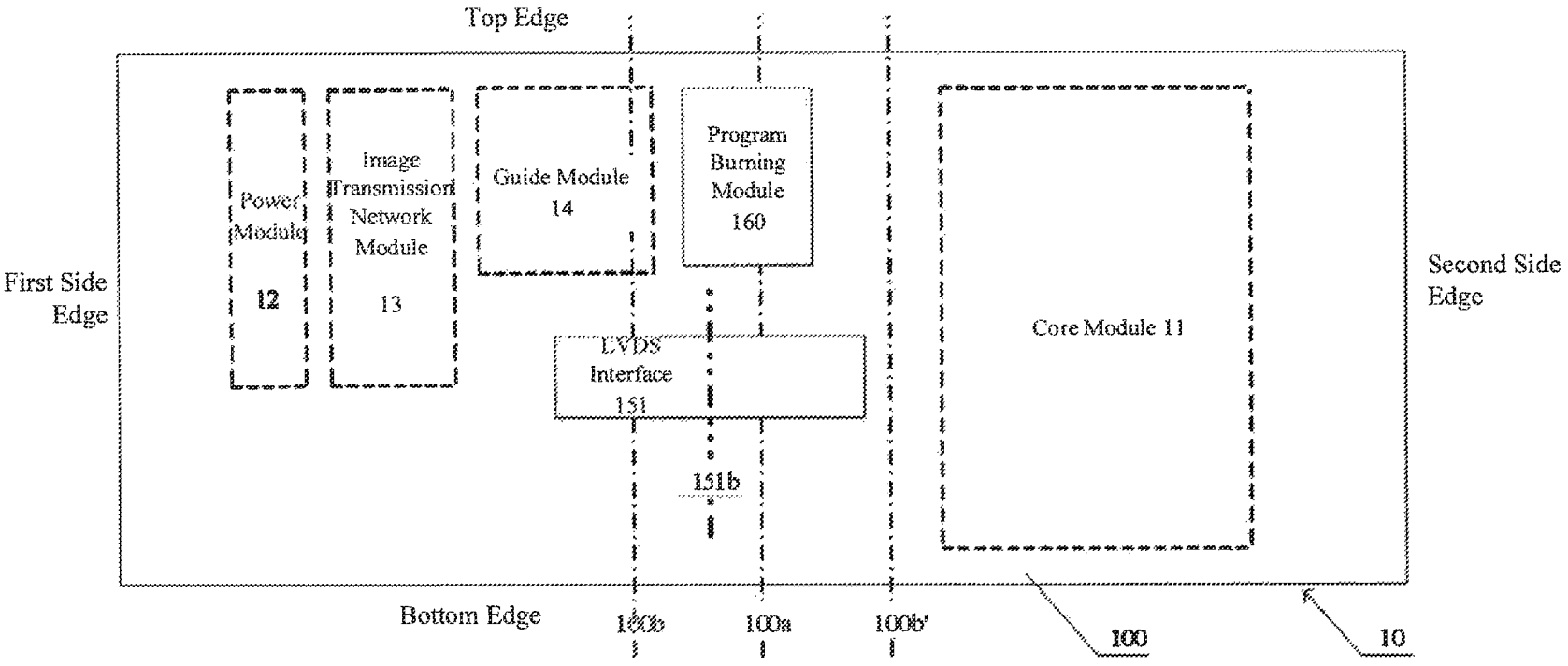
FIG. 2 is a schematic structural view of another display control system provided by an embodiment of the present disclosure.

In another possible implementation of the embodiment of the present disclosure, the center line of the length, in the extension direction of the top edge of the image data output interface 151, is within a deviation threshold away from the center line of the top edge on two sides of the center line of the top edge along the extension direction of the top edge. For example, FIG. 2 is a schematic structural view of another display control system provided by at least one embodiment of the present disclosure. It should be noted that other unmentioned features and effects of the embodiment as illustrated in FIG. 2 are the same as those as illustrated in FIG. 1 and are not be repeated, and only the differences from the embodiment as illustrated in FIG. 1 are described here. As illustrated in FIG. 2, the LVDS interface 151 in the SOC 10 is arranged at a certain deviation range away from the center line of the entire circuit board 100 in the direction from left to right in FIG. 2. For example, a center line 151*b* of the length of the LVDS interface 151 of the SOC 10 in the extension direction of the top edge is within the deviation threshold away from the center line 100*a* of the top edge on the left side and the right side of the center line 100*a* of the top edge in the extension direction of the top edge. As illustrated in FIG. 2 which is a schematic structural view of another display control system provided by the embodiment of the present disclosure, the LVDS interface 151 in FIG. 2 is illustrated by taking the case that the center line 151*b* is within the deviation threshold away from the center line 100*a* of the top edge on the left side and the right side of the center line 100*a* of the top edge in the extension direction of the top edge as an example; the reference numeral 100*b* represents a deviation threshold away from the center line 100*a* of the top edge on the left side, and the reference numeral 100*b*' represents the deviation threshold away from the center line 100*a* of the top edge on the left side; the center line 151*b* may be within the range from 100*b* to 100*b*'; and the distance between 100*b* and 100*b*' may be reasonably determined according to the position of the LVDS interface in the strip display screen and the overall structure of the SOC 10, for example, is ¼ of the length of the LVDS interface in the extension direction of the top edge.

It should be noted that the LVDS interface 151 and the program burning module 160 as illustrated in FIGS. 1 and 2 are illustrated by solid line icons, and the core module 11, the power module 12, the image transmission network module 13 and the guide module 14 are illustrated by dotted line icons. The solid line icons in the accompanying drawings of the embodiments of the present disclosure indicate devices, modules and interfaces, and the dotted line icons indicate functional circuits which are usually composed of multiple devices.

For example, the core module 11 includes a core circuit; the power module 12 includes a power circuit; the image transmission network module 13 includes an Ethernet circuit; and the guide module 14 includes a guide circuit.

For example, an Ethernet circuit 130, for example, may adopt a kilomega network circuit, a 100M network circuit, etc. The core circuit 110, for example, adopts devices such as a master chip, a double data rate synchronous dynamic random access memory (DDR), an embedded multimedia card (EMMC) and a master chip power source. The volume of the core circuit 110 is relatively large compared with other circuits. The core circuit 100 may be arranged according to the remaining position after other circuits, modules and interfaces in the circuit board 100 are arranged. The specific layout of the core circuit may be to select a suitable position for layout according to the remaining position in the circuit board 100 and the chip signal used by the core circuit 110.

Figure 3:
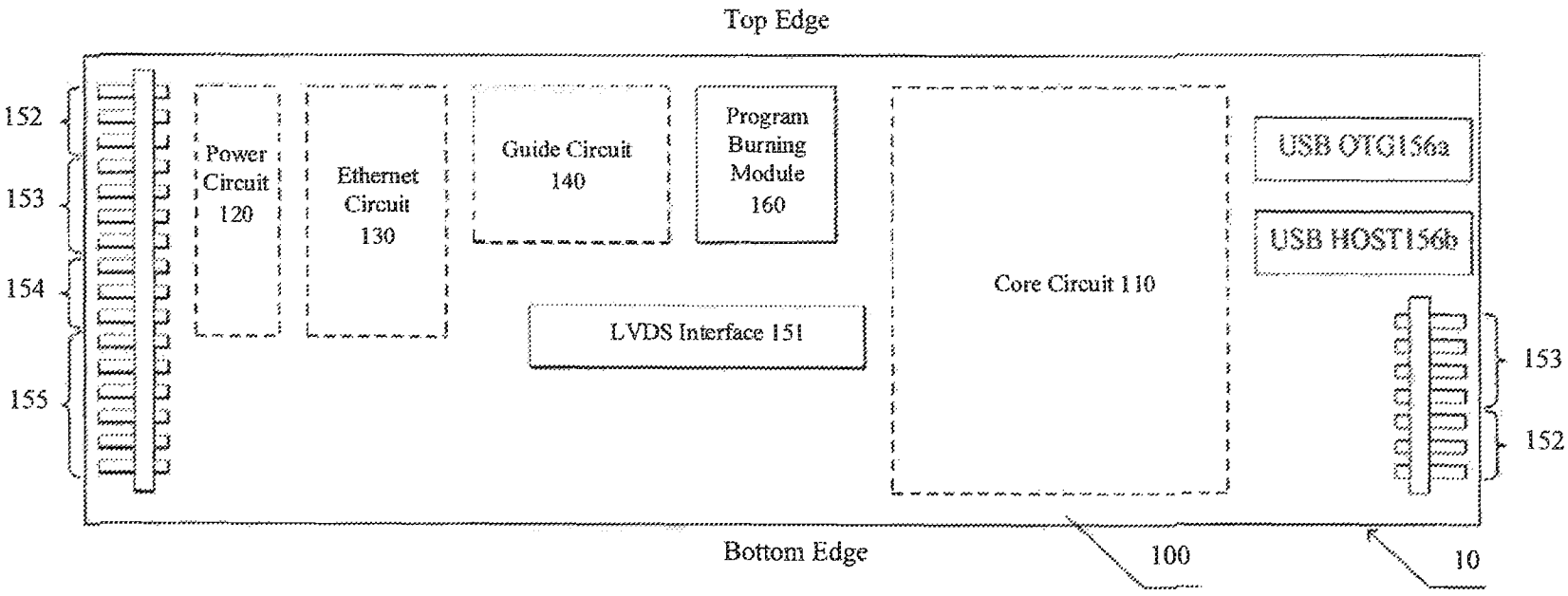
FIG. 3 is a schematic structural view of still another display control system provided by an embodiment of the present disclosure.

For example, FIG. 3 is a schematic structural view of still another display control system provided by the embodiment of the present disclosure. It should be noted that other unmentioned features and effects of the embodiment as illustrated in FIG. 3 are all the same with those as illustrated in FIG. 1 and will not be repeated, and only the differences from those in the embodiment as illustrated in FIG. 1 are described here. The embodiment as illustrated in FIG. 3 takes the following as an example: the core module 11 is a core circuit 100; the power module 12 is a power circuit 120; the image transmission network module 13 is an Ethernet circuit 130; and the guide module 14 is a guide circuit 140. The core circuit 110, the power circuit 120, the Ethernet circuit 130 and the guide circuit 140 are arranged along the extension direction of the top edge of the circuit board 100.

As illustrated in FIG. 3, the display control system, e.g., the SOC 10, provided by the embodiment of the present disclosure may further comprise interfaces arranged along two side edge of the circuit board 100, for example, including a plurality of interfaces. The plurality of interfaces are arranged along at least one of the first side or the second side. In the embodiment, a plurality of interfaces are arranged along both the first side and the second side. The plurality of interfaces include at least one of a voltage interface 152, a serial peripheral interface (SPI), an internal integrated circuit bus (IIC) interface 154, a serial interface 155 or a universal serial bus (USB) interface, wherein the USB interface includes one or more of a USB On-The-Go (USB OTG) 156*a* and a USB HOST 156*b*. The SOC 100 as illustrated in FIG. 3 is illustrated by taking the case that all the above interfaces are arranged on the first side and the second side of the circuit board 100 as an example.

In the embodiment of the present disclosure, the above interfaces are arranged on two side edge of the circuit board 100, and when external devices or lines are inserted or accessed from a side surface of the circuit board 100, the installation of a shell of the strip display screen is not affected. If the above interfaces are arranged on upper and lower side edge of the circuit board 100, namely at the positions of the bottom edge or the top edge, when devices or lines are externally connected, the operation can only be performed after the shell of the strip display screen is removed, which is very inconvenient.

Optionally, in the embodiment of the present disclosure, the above interfaces adopt one or more of the following setting methods:

Firstly, the above voltage interface 152, the SPI 153, the IIC interface 154 and the serial interface 155 adopt horizontal patch pin header.

Secondly, the serial interface 155 adopts transistor-transistor logic (TTL) mode.

Thirdly, the voltage interface 152 is arranged on two side edge of the circuit board 100; the voltage interface is arranged on both the first side and the second side; at least one of the SPI or the IIC interface is arranged on both the first side and the second side; and the number of the SPIs 153 and the IIC interfaces 154 is not limited.

For example, the voltage interface 152, the SPI 153, the IIC interface 154 and the serial interface 155 are sequentially arranged on the first side of the circuit board 100, and the USB OTG 156*a*, the USB HOST 156*b*, the SPI and the voltage interface are sequentially arranged on the second side of the circuit board 100.

The SOC 10 as illustrated in FIG. 3 is illustrated by taking the case that all the above interfaces are arranged on two side edge of the circuit board 100 and the setting method of the interface includes all the above setting methods as an example. In the embodiment of the present disclosure, the serial interface 155 adopts TTL mode, is an interface that transmits data in parallel means, and is not adapted to adopt a serial communication interface RS-232 standard interface. The RS-232 interface is too high and too large, so the SOC 10 cannot be mounted on the small strip display screen, and the overall thickness will be increased. The serial interface 155, the voltage interface 152, the SPI 153 and the IIC interface 154 may all adopt horizontal patch pin header. The horizontal mode can reduce the height of the device and reduce the thickness of the whole machine (namely the whole SOC 10). In addition, there are two types of USB interfaces. The USB OTG 156*a* is used for programming. For example, when the display control system may not comprise the program burning module, a program burning module is externally arranged through the USB OTG 156*a*. The USB HOST 156*b* is used to be externally connected with general external devices, for example, being externally connected with a mouse, a keyboard, etc. The serial interface 155 is used for reading console information and performing program debugging. The SPI 153 and the IIC interface 154 are configured to be connected with external devices, for example, being externally connected with a near field communication (NFC) chip, an analog-to-digital converter (ADC) chip and the like, and develop auxiliary functions. For example, when the display control system is applied to the display on the shelf, the shelf is provided with a label, and the ADC chip includes a touch resistor. The resistance of the resistor can be changed by touching, so that the position of the label can be changed through a control module (for example, including a control circuit, a displacement device, etc.) connected with the label. External devices must be connected to the voltage interface 152 and the SPI interface 153 (or the IIC interface 154). Whether to select the SPI interface 153 or the IIC interface 154 depends on the interface or the signal line used by the NFC chip and the ADC chip. The arrangement of the voltage interface 152, the SPI interface 153 and the IIC interface 154 on two side edge of the circuit board 100 is for the connection of multiple devices at two ends of the strip display screen. FIG. 3 takes the case that the voltage interface 152, the SPI interface 153 and the IIC interface 154 are arranged on the left side of the circuit board 100 and the voltage interface 152 and the SPI interface 153 are arranged on the right side as an example. The output of the voltage interface 152 may be 12V, 5V and 3.3V, so as to satisfy the requirements of various external devices.

It should be noted that the setting positions of the above interfaces on the two side edges of the circuit board 100 are not limited in the embodiment of the present disclosure; FIG. 3 is only illustrative description; and the positions of the above pin header interfaces and the USB interfaces on the two side edges of the circuit board 100 as illustrated in FIG. 3 can be exchanged according to actual application conditions, but must satisfy the requirement that the above interfaces are all arranged on the two side edges of the circuit board 100.

For example, in the embodiment of the present disclosure, the power circuit 100 and the Ethernet circuit 130 may be disposed at positions, close to the interfaces on the side edge, in the circuit board 100, for example, disposed at positions closest to the first side edge, as illustrated in FIG. 3, which is favorable for the completeness of signals in the power circuit 110 and the Ethernet circuit 130 and the layout of signal lines.

Figure 4:
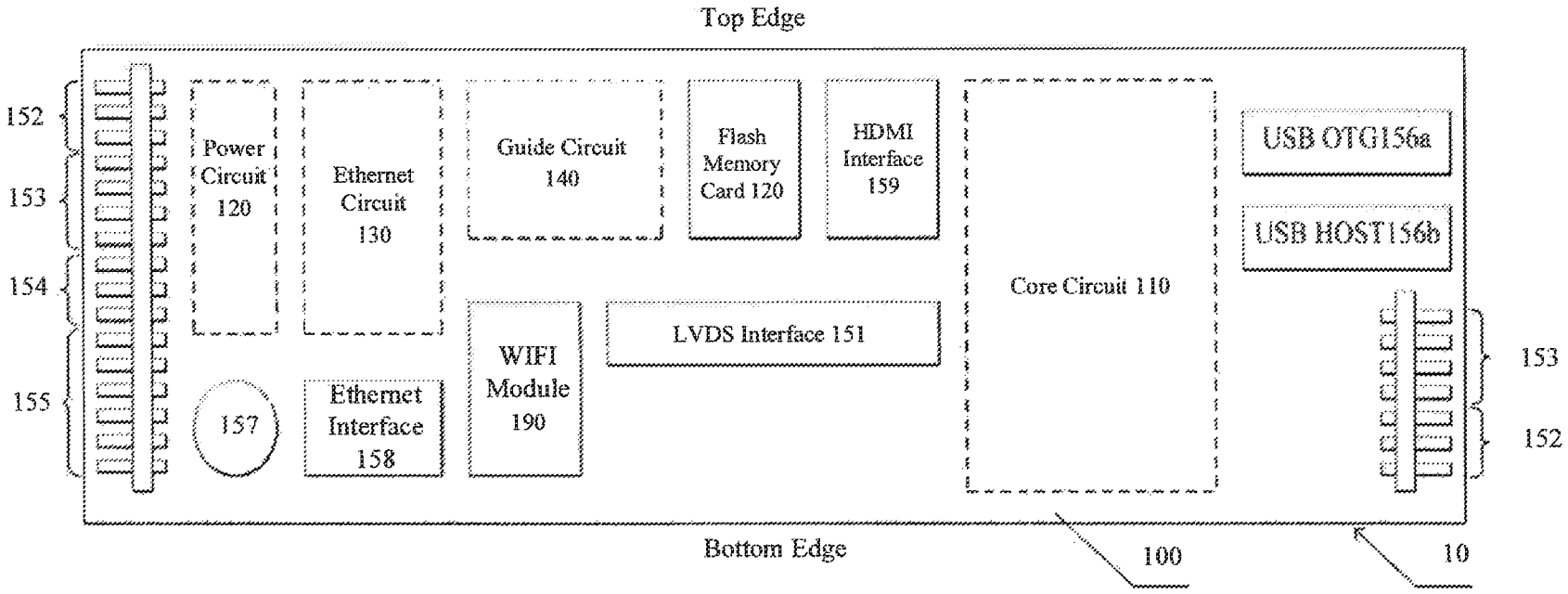
FIG. 4 is a schematic structural view of still another display control system provided by an embodiment of the present disclosure.

For example, FIG. 4 is a schematic structural view of still another display control system provided by the embodiment of the present disclosure. On the basis of the structure of the display control system as illustrated in FIG. 3, the display control system, e.g., the SOC 10, provided by the embodiment of the present disclosure may further comprise: a power interface 157 and an Ethernet interface 158. The Ethernet interface 158 is arranged between the power module 12, for example, the power circuit 120, and the bottom edge of the circuit board 100, and is arranged between the Ethernet circuit 130 and the bottom edge of the circuit board 100; no module is between the power interface 157 and the bottom edge of the circuit board 100, and no module is arranged between the Ethernet interface 158 and the bottom edge of the circuit board 100, so as to avoid the signal interference to the Ethernet interface.

In the embodiment of the present disclosure, the power interface 157 and the Ethernet interface 158 are arranged at the bottom edge of the circuit board 100 and respectively correspond to the position of the power circuit 120 and the position of the Ethernet circuit 130. Because the SOC 10 can be combined with the strip display screen and mounted on the shelf together, if the power interface 157 and the Ethernet interface 158 are near the top edge of the circuit board 100, the strip display screen cannot be directly mounted on the shelf, therefore the power interface 157 and the Ethernet interface 158 arranged near the bottom edge of the circuit board 100 are favorable for the subsequent installation of the strip display screen.

In actual application, the power interface 157 and the Ethernet interface 158 are upright interfaces. The power interface 157 and the Ethernet interface 158 cannot be lateral interfaces. Connection wires come out from the back of the whole machine (the combination of the SOC 10 and the strip display screen), in this case, lateral interfaces are unfavorable for the wire connection after the installation of the strip display screen, and the complexity is increased with the lateral interfaces, and upright interfaces can avoid this problem. The Ethernet is used for the transmission and update of programs and videos, and the synchronization of the time of the videos of a plurality of strip display screens may also be realized through the Ethernet. In the working process, the Ethernet interface 158 receives signals, and the Ethernet circuit 130 processes the signals. If the Ethernet circuit 130 is a kilomega network circuit, the Ethernet interface 158 is correspondingly a kilomega network interface.

For example, in the embodiment of the present disclosure, the program burning module 160 may include a flash memory card 161 arranged along the extension direction of the top edge of the circuit board 100. In some other embodiments of the present disclosure, the program burning module 160 may be an external device (e.g., a flash memory card), for example, is connected to the display control system through the USB OTG 156*a* arranged along the side of the circuit board 100. The above embodiment has explained that the arrangement positions are also different according to the difference of hardware devices of the program burning module 160.

The SOC 10 as illustrated in FIG. 4 is illustrated by taking the simultaneous arrangement of the flash memory card 161 and the USB OTG 156*a* as an example, and both the two hardware can realize the function of program burning. In addition, the flash memory card 161 can also be used for storing videos. The flash memory card 161, for example, may be a trans-flash (TF) card, a secure digital (SD) card, or other types of flash memory cards. Taking consideration of the factors that the area of the circuit board 100 is relatively small and a plurality of devices and circuits must be arranged on the circuit board 100, a TF card with a small volume may be selected.

Figure 7:
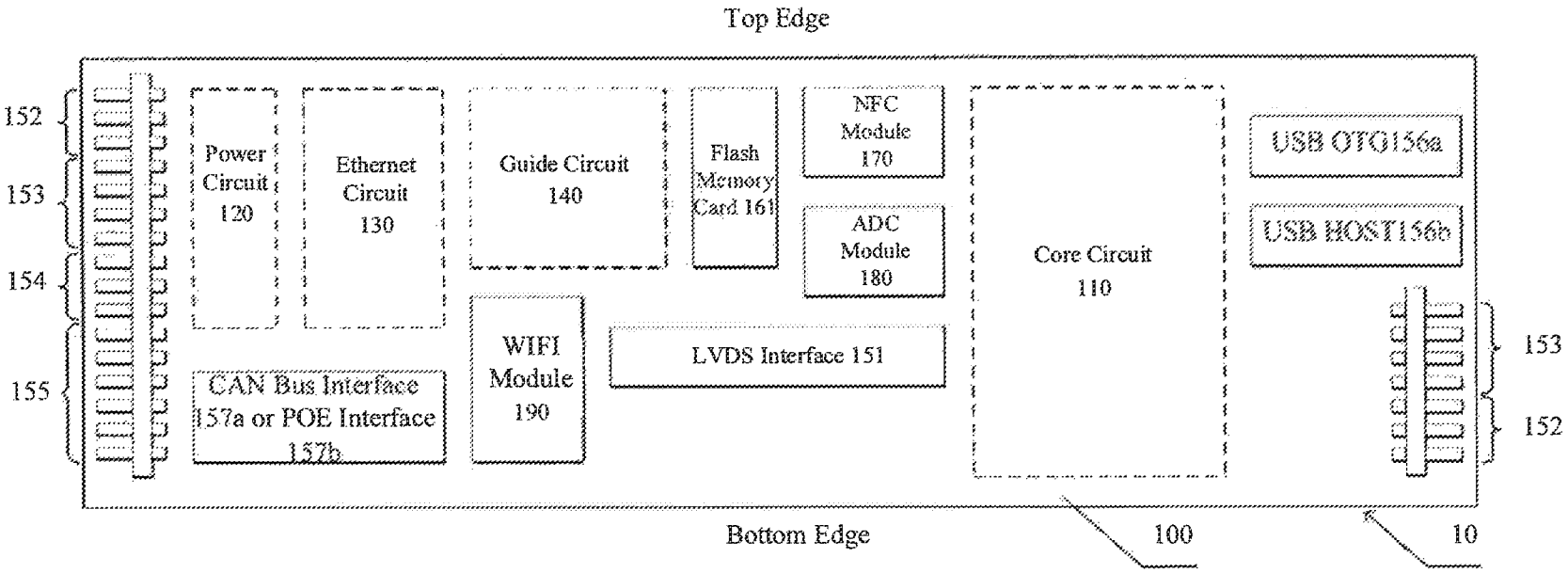
FIG. 7 is a schematic structural view of still another display control system provided by an embodiment of the present disclosure.

For example, the display control system, e.g., the SOC 10, provided by the embodiments of the present disclosure may further comprise at least one selected from a group consisting of an NFC module 170 and an ADC module 180. The NFC module 170 and the ADC module 180 are arranged along the extension direction of the top edge of the circuit board 100. For example, as illustrated in FIG. 7, the SOC 10 comprises an NFC module 170 and an ADC module 180 which are sequentially arranged along the direction from a position close to the top edge to a position away from the top edge. In other embodiments, the positions of the NFC module 170 and the ADC module 180 in FIG. 7 may also be exchanged, or the NFC module 170 and the ADC module 180 are sequentially arranged along the extension direction of the top edge.

For example, the display control system, e.g., the SOC 10, provided by the embodiment of the present disclosure may further comprise an HDMI interface 159. The HDMI interface may be used in a stage before or during the working process of the SOC 10, and is configured to debug display image information transmitted to the display screen. For example, another display is connected to the SOC 10 through the HDMI interface. The display screen may display a whole image, but the strip display screen equipped with the SOC 10 only needs to display a part of the image. In this case, the image displayed by the strip display screen may be adjusted by the debugging process performed by the HDMI interface. The length of the HDMI interface is large. For example, the HDMI interface and the plurality of function modules are arranged along the extension direction of the top edge. For example, a side with large length is extended along the extension direction of the top edge, so as to fully utilize the top edge which is longer than the side edges, thereby reasonably utilizing the space of the circuit board 100.

For example, as illustrated in FIG. 4, the display control system, e.g., the SOC 10, provided by the embodiment of the present disclosure further comprises a wireless fidelity (WIFI) module 190. The WIFI module 190 is disposed on a side, close to the bottom edge, of at least some function modules of the plurality of function modules and includes an antenna terminal. The antenna terminal is close to the bottom edge. The SOC 10 as illustrated in FIG. 4 is illustrated by taking the arrangement of the HDMI interface 159 and the WIFI module 190 as an example. Because the strip display screen is usually thin, in order to reinforce the strip display screen, a metal layer is disposed between a non-display side of the strip display screen and the SOC 10. Moreover, the function modules arranged on a side, close to the top edge, of the WIFI module include various metal elements, thus WIFI signals cannot be propagated through a side, close to the top edge, of the WIFI module or a side, facing the strip display screen, of the WIFI module. Thus, in the case where the antenna terminal of the WIFI module 190 is disposed on a side, close to the bottom edge, of the WIFI module 190, the WIFI signals can be propagated through gaps between the bottom edge and the strip display screen, so that the propagation intensity of the WIFI signals is improved. For example, in the case where the SOC 10 is mounted on the strip display screen, e.g., the strip display screen is disposed on the shelf, the above top edge is close to the top side of the shelf. There are goods and other part of the shelf on the top side of the shelf, thus signals are blocked by the goods and other part of the shelf. Moreover, the space at the bottom edge of the shelf is large and is favorable for signal propagation, and the WIFI signals can be used for the wireless transmission and synchronization of videos. Thus, the WIFI module 190 is not disposed on the top of the circuit 100.

In the SOC 10 as illustrated in FIG. 4, the circuits, the interfaces and the devices are illustrated by taking the following specific layout as an example: the voltage interface 152, the SPI 153, the IIC interface 154 and the serial interface 155 are sequentially arranged on the left side of the circuit board 100 along the direction from the top to the down in the figure, and the USB OTG 156*a*, the USB HOST 156*b*, the SPI 153 and the voltage interface 152 are sequentially arranged on the right side of the circuit board 100 along the direction from the top to the down in the figure.

For example, as illustrated in FIG. 4, in the case where the display control system comprises the above program burning module 460 and the above WIFI module 190, the power module 12, e.g., the power circuit 120, the Ethernet circuit 130, the guide module 14, the program burning module 160, the HDMI interface 15, and the core module 11, e.g., the core circuit 110, are sequentially arranged along the extension direction of the top edge, the image data output interface is disposed between the WIFI module 190 and the core module 11, and the WIFI module 190 is disposed between the guide circuit 140 and the bottom edge of the circuit board 100. Because the power interface 157 and the Ethernet interface 158 are arranged on a side, close to the bottom edge, of both the power circuit 120 and the Ethernet circuit 130, the WIFI module 190 is disposed between the guide circuit 140 and the bottom edge of the circuit board 100 so as to fully utilize the space. Moreover, the image data output interface is disposed between the WIFI module 190 and the core module 11 so that the image data output interface is closer to the core circuit 110, which is beneficial for the image data output interface to be connected with the core circuit 110.

It should be noted that the structural diagram as illustrated in FIG. 4 is a schematic diagram illustrating the basic positions of the main devices such as interfaces, modules and circuits in the SOC 10. The embodiment of the present disclosure does not limit the specific positions of the circuits, the modules and the interfaces in the circuit board 100 in the SOC 10 as illustrated in FIG. 4, only needing to accord with the principles of the arrangement of the circuits and the modules; and the positions of partial circuits, modules and interfaces can be adjusted and exchanged. For example, the left and the right of the structure in the entire circuit board 100 as illustrated in FIG. 4 may be of mirror symmetry. Moreover, for example, the positions of the flash memory card 161, the HDMI interface 159 and the guide circuit 140 in FIG. 4 are all near the top edge of the circuit board 100, and the heights of the three devices in the direction perpendicular to the circuit board 100 are similar to each other, so the positions of the three devices can be exchanged with each other.

Figure 5:
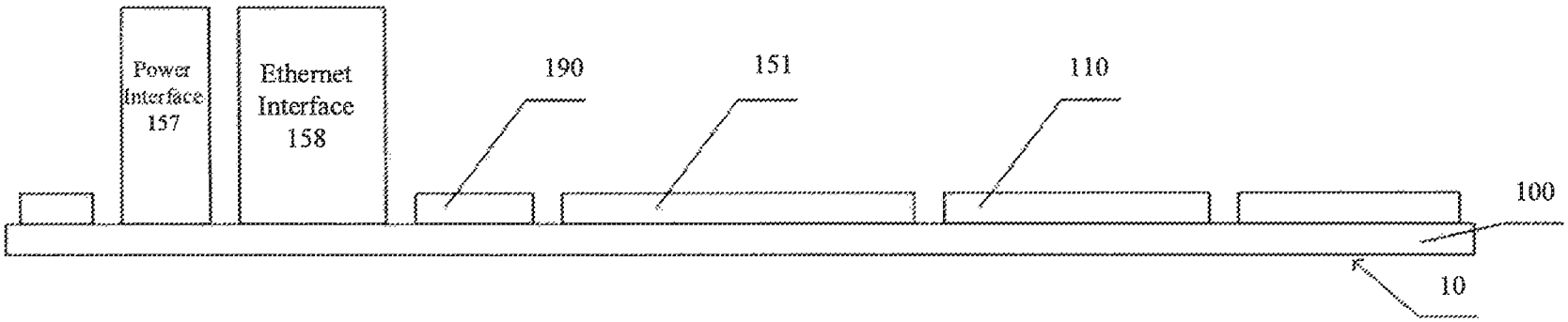
FIG. 5 is a side view of the display control system provided by the embodiment as illustrated in FIG. 4.

FIG. 5 is a side view of the display control system provided by the embodiment as illustrated in FIG. 4. FIG. 5 is a schematic diagram taking the side of the bottom edge of the circuit board 100 as the viewing angle. FIG. 5 shows interfaces with horizontal patch pin structures on the two side edges of the circuit board 100, the power interface 157, the Ethernet interface 158, the WIFI module 190 and the core circuit 110 that are close to the bottom edge of the circuit board 100, and the LVDS interface 151 arranged at the center of the circuit board 100. Because no other device is arranged between the bottom edge of the circuit board 100 and any one of the above interfaces, modules and circuits, the above interfaces, modules and circuits can be viewed from the side of the bottom edge of the circuit board 100.

For example, FIG. 7 is a schematic structural view of still another display control system provided by an embodiment of the present disclosure. The embodiment as illustrated in FIG. 7 has the following differences from the embodiment as illustrated in FIG. 4. In the display control system, e.g., the SOC 10, provided by the embodiment as illustrated in FIG. 7, the power module and the Ethernet circuit 130 are adjacent to each other, the display control system comprises one selected from a group consisting of a controller area network (CAN) bus interface and a power over Ethernet (POE) interface that are disposed between the bottom edge of the circuit board 100 and both of the power module, e.g., the power circuit 120, and the Ethernet circuit 130, and the one selected from the group consisting of the CAN bus interface and the POE interface is connected with the power module 12 and the Ethernet circuit 130; the power module and the Ethernet circuit 130 are adjacent to each other, so as to realize the convenience of connection between the one selected from the group, consisting of the CAN bus interface and the POE interface, and both of the power module 12 and the Ethernet circuit 130. For example, no module is disposed between the CAN bus interface and the bottom edge of the circuit board 100, or no module is disposed between the POE interface and the bottom edge of the circuit board 100. That is, the power interface 157 and the Ethernet interface 158 in the SOC 10 as illustrated in FIG. 4 are replaced by the CAN bus interface 157*a* or the POE interface 157*b*; and the positions of the above CAN bus interface 157*a* or the POE interface 157*b* are similar to the positions of the power interface 157 and the Ethernet interface 158, and may be between the bottom edge of the circuit board 100 and both of the power circuit 120 and the Ethernet circuit 130. In addition, the SOC 10 as illustrated in FIG. 7 is not provided with the HDMI interface 159, and the NFC module 170 and the ADC module 180 are sequentially arranged, along the direction from the top to the down in the figure, at the position of the above-mentioned HDMI interface 159 as illustrated in FIG. 4.

The embodiment of the present disclosure adopts the CAN bus interface 157*a* or the POE interface 157*b* to transmit power signals and video signals, that is, the CAN bus interface 157*a* or the POE interface 157*b* can realize the functions of the power interface 157 and the Ethernet interface 158. The CAN bus interface 157*a* or the POE interface 157*b* can directly transmit video signals and synchronous signals to the SOC 10, and meanwhile, any one selected from the group consisting of the interface 157*a* or the POE interface 157*b* can further connect the power supply with an input wire by adding a power input and a ground wire, without providing two interfaces to realize this, so as to be easy to assemble. For the convenience of connection, the CAN bus interface 157*a* or the POE interface 157*b* in the embodiment of the present disclosure may also adopt upright interface.

Figure 8:
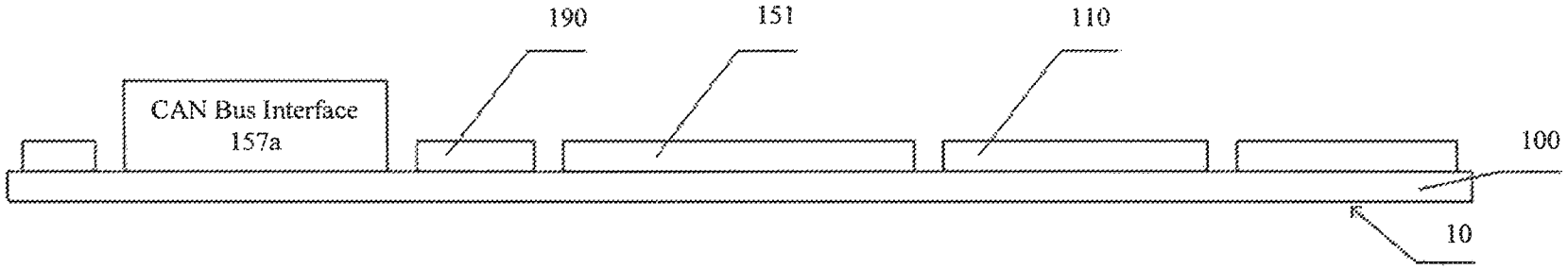
FIG. 8 is a side view of the display control system provided by an embodiment as illustrated in FIG. 7.

Moreover, compared with arranging the power interface 157 and the Ethernet interface 158, the arrangement of the CAN bus interface 157*a* in the circuit board 100 is more flexible, can obviously reduce the interface height, and reduce the installation difficulty of the whole strip display screen. FIG. 8 is a side view of the display control system provided by the embodiment as illustrated in FIG. 7. FIG. 8 is also a schematic diagram in which the side of the bottom edge of the circuit board 100 is taken as the viewing angle. Moreover, FIG. 8 is illustrated by taking the case that the power interface 157 and the Ethernet interface 158 are replaced by the CAN bus interface 157*a* as an example. Obviously, the height of the CAN bus interface 157*a* in the direction perpendicular to the circuit board 100 is relatively low, which is favorable for installation of the strip display screen. Because the CAN bus interface 157*a* may have different specifications, for example, may adopt a special element and may also adopt pins to form the interface, the height of the element of the CAN bus interface 157*a* in the direction perpendicular to the circuit board 100 may be changed according to the height of the CAN bus interface 157*a* in the direction perpendicular to the circuit board 100.

In the structure of the SOC 10 as illustrated in FIG. 7, the HDMI interface 159 in the SOC 10 as illustrated in FIG. 4 is removed. The HDMI interface 159 provides convenience for the engineer to debug the whole image of the strip display screen, but the HDMI interface 159 therein can be replaced after programs are debugged through a layout circuit of the SOC 10 as illustrated in FIG. 4, that is, a layout circuit of the SOC 10 as illustrated in FIG. 7 is adopted for display, and the HDMI interface 159 may be not required for debugging in the process of subsequent display.

Figure 6:
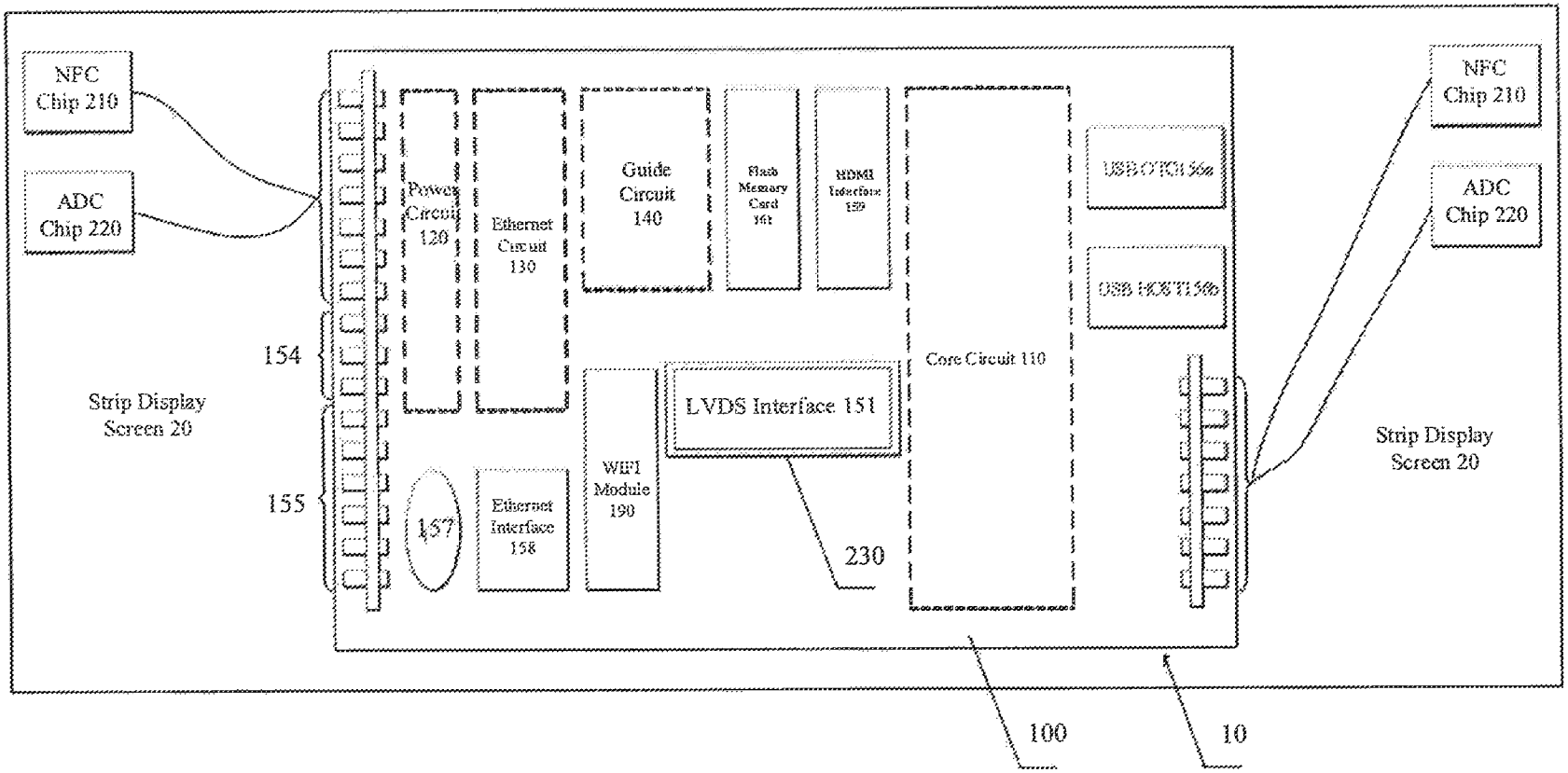
FIG. 6 is a schematic installation diagram illustrating the installation of the display control system provided by the embodiment as illustrated in FIG. 4 on a strip display screen.
Figure 9:
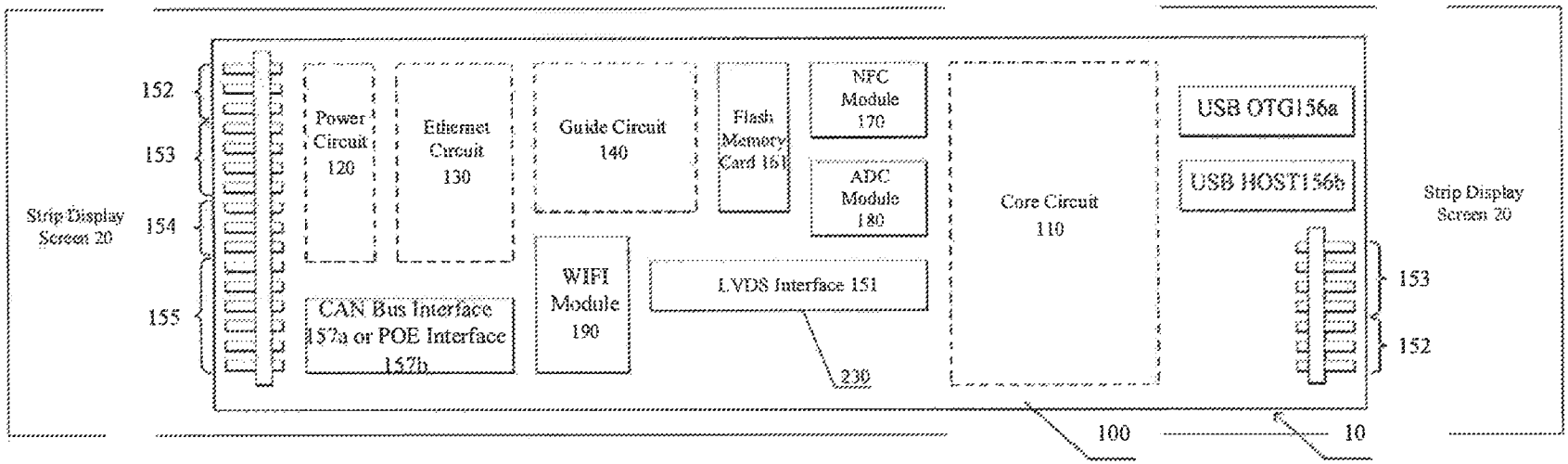
FIG. 9 is a schematic installation diagram illustrating the installation of the display control system as illustrated in FIG. 7 on a strip display screen.

In the installation diagram of the SOC 10 and the strip display screen 20 as illustrated in FIG. 6, because modules with NFC and ADC functions are not arranged in the SOC 10, the NFC and ADC functions must be realized through the assembly of external functions, so the expansion of the functions must be completed by additional wirings and additional structural design. As seen from FIG. 6, both an NFC chip 210 and an ADC chip 220 that have an expansion function are connected with corresponding interfaces in the SOC 10 through external wires. FIG. 9 is an installation diagram illustrating the installation of the display control system provided by the embodiment as illustrated in FIG. 7 on the strip display screen. As can be seen, as the SOC 10 as illustrated in FIG. 7 are provided with the NFC module 170 and the ADC module 180, in the case where the SOC 10 as illustrated in FIG. 7 is mounted on the strip display screen 20, the additional wires and additional structures in the assembly structure as illustrated in FIG. 6 are not necessary, but the NFC and ADC functions are integrated onto the SOC 10, so as to save the cost of the external circuit and the external structures.

It should be noted that the NFC module 170 may be arranged at a position close to the edge of the circuit board 100. FIG. 7 is illustrated by taking the case that the NFC module 170 is close to the top edge of the circuit board 100 as an example, as arranging an NFC antenna at the edge is more favorable for receiving signals of external devices. In addition, in the case of allowable space in the circuit board 100 of the SOC 10, the HDMI interface 159, the NFC module 170 and the ADC module 180 can all be arranged in the circuit board 100 in accordance with the arrangement principles of the interfaces and the modules described in the above embodiments of the present disclosure.

Both the installation diagrams of the SOCs 10 as illustrated in FIG. 6 and FIG. 9 and the strip display screen 20 are illustrated by taking the case that the SOC 10 is mounted at the center of the strip display screen 20 as an example, and the LVDS interface 151 of the SOC 10 is connected with the LVDS interface of the strip display screen 20 during installation.

The embodiment of the present disclosure further provides a display apparatus, and the display apparatus comprises a strip display screen and any one of the display control systems provided by the embodiments of the present disclosure. The strip display screen includes an image data input interface. The display control system is disposed on a non-display side of the strip display screen, and an image data output interface of the display control system is connected with the image data input interface of the strip display screen.

With reference to FIGS. 6 and 9 which are schematic structural views of the strip display apparatus provided by an embodiment of the present disclosure, the strip display apparatus provided by the embodiment of the present disclosure comprises: a strip display screen 20 and an SOC 10 disposed on the strip display screen 20. The SOC 10 may be the display control system provided by any one of the above embodiments of the present disclosure.

In the strip display apparatus as illustrated in FIG. 6 and FIG. 9, the SOC 10 is mounted on the back of the strip display screen 20, and the image data output interface 151 (e.g., the LVDS interface 151 in the figure) of the SOC 10 is connected with the image data input interface 230 of the strip display screen 20. Both FIG. 6 and FIG. 9 show the structure of the SOC 10 mounted on the back of the strip display screen 20 by taking the case that the image data output interface 151 is the LVDS interface 151 as an example. In the case where the SOC 10 is mounted on the strip display screen, the image data output interface 151 on the circuit board 100 of the SOC must be connected with the image data input interface 230 in the strip display screen 20, so as to transmit the display image data from the core module 11 to the strip display screen 20. Thus, the position of the image data output interface 151 on the circuit board 100 corresponds to the position of the image data input interface 230 in the strip display screen. For example, the image data input interface 230 in the strip display screen 20 is arranged at the center of the display screen, and for example, the image data output interface 151 in the SOC 10 designed for this strip display screen may be arranged at the center of the circuit board 100.

It should be noted that in the embodiment of the present disclosure, the center of an A structure refers to the geometric center of a planar shape of the A structure. For example, the planar shape of the circuit board 100 is rectangle, and the center of the circuit board is an intersection point of the diagonals of the rectangle; and the planar shape of the strip display screen 20 is rectangle, and the center of the circuit board is an intersection point of the diagonals of the rectangle.

The size of the circuit board 100 of the display control system, e.g., the SOC, provided by the embodiment of the present disclosure may be adapted to the structure of the strip display screen, and the structure has a large length-width ratio. In actual application, the width of the circuit board 100 is smaller than the width of the strip display screen (the width of the circuit board of the traditional SOC is usually larger than the width of the strip display screen), and the length of the circuit board 100 is determined by the hole site of retaining screws on the back of the strip display screen. In general, the length of the circuit board 100 is required to not exceed the distance between screw holes on the back of the strip display screen. Thus, in the case where the SOC 10 is mounted on the strip display screen, the top edge and the bottom edge of the SOC are respectively close to the top edge and the bottom edge of the strip display screen, and there is certain space respectively from two side edges of the SOC to the side edges of the strip display screen. Firstly, the circuits and the modules in the circuit board can be arranged along the top edge of the circuit board on the basis of the shape of the circuit board 100, so as to achieve the effect of reasonable layout. As the program burning module 160 may be formed by different hardware, the position of the program burning module may be determined according to the type of the specific element of the program burning module. Secondly, the image data input interface 230 in the strip display screen 20 is usually disposed at the center of the whole screen, and in the case where the SOC 10 is mounted on the strip display screen, the position of the image data output interface of the SOC is usually required to be consistent to or close to the position of the image data input interface 230 in the strip display screen, so as to facilitate installation of the strip display screen and arranging the wires.

For example, the display control system, e.g., the SOC 10, is arranged at the center of the strip display screen. For example, an orthographic projection of the center of the image data output interface 151 of the display control system on the circuit board 100 coincides with an orthographic projection of the center of the image data input interface 230 of the strip display screen on the circuit board.

For example, the image data output interface 151 of the display control system is connected with the image data input interface 230 of the display through a flexible printed circuit board (FPC) cable. The FPC cable is relatively thin, which is favorable for forming the thin strip display apparatus, therefore the strip display apparatus is more applicable to various application scenes requiring the strip display apparatus such as supermarket shelves. But the FPC cable cannot be twisted. Thus, the case that the orthographic projection of the center of the image data output interface 151 of the display control system on the circuit board coincide with the orthographic projection of the center of the image data input interface 230 of the strip display screen 20 on the circuit board facilitates the installation of a connecting wire, namely the FPC cable.

For example, the orthographic projection of the image data output interface 151 of the display control system on the circuit board coincide with the orthographic projection of the image data input interface 230 of the strip display screen 20. Thus, interfaces with same specification are formed at two ends of the FPC cable so as to facilitate manufacturing and obtaining.

FIG. 6 is an installation diagram illustrating the installation of the display control system provided by the embodiment as illustrated in FIG. 4 on the strip display screen. For example, the strip display screen has side edge extended along the extension direction of the side of the circuit board 100, and includes function modules disposed on the side edge of the strip display screen. When the display control system comprises the voltage interface and the SPI, the display control system is connected with the function modules through the voltage interface and the SPI. For example, the function modules may include chips, circuits, etc. One or more of the voltage interface 152 and the SPI 153 of the circuit board 100 are connected with the function modules disposed on two side edge of the strip display screen 20. The function modules are, for example, expansion chips, e.g., the NFC chip 210 and the ADC chip 220 as illustrated in FIG. 6. As the SOC 10 as illustrated in FIG. 4 is illustrated by taking the case that the NFC module 170 and the ADC module 180 are not arranged as an example, when the expansion functions of the NFC and the ADC are required, the above functions may be expanded through the voltage interface 152 and the SPI 153 on two side edge of the circuit board 100.

As illustrated in FIG. 6, the SOC 10 is mounted at the center of the strip display screen 20, and may be connected with the NFC chip 210 and the ADC chip 220 on two side edge of the strip display screen 20 through the voltage interface 152 and the SPI 153 of the SOC 10, so as to realize function expansion. The expansion chips (including the NFC chip 210 and the ADC chip 220) may be fixed at any position on two side edge of the strip display screen 20. The voltage interface 152 provides supply voltage, and the SPI interface 153 performs signal processing. FIG. 6 is illustrated by taking the case that the SPI 153 is connected with an external device as an example. If the external device adopts the IIC interface, the IIC interface 154 is connected with the external device. On the basis that the voltage interface 152 and the SPI 153 are arranged on two side edge of the circuit board 100 in the SOC 10 as illustrated in FIG. 4, in the mounting structure of the SOC 10 and the strip display screen 20 as illustrated in FIG. 6, the NFC chip 210 and the ADC chip 220 are arranged on two side edge of the strip display screen 20, and the NFC chip 210 and the ADC chip 220 on two side edge of the strip display screen are respectively connected with the voltage interface 152 and the SPI 153 on the same side of the SOC 10.

It should be noted that when the SOC 10 provided by the embodiment of the present disclosure is mounted on the strip display screen 20, the case that the voltage interface 152 and the SPI 153 on two side edge of the circuit board 100 are connected with the expansion chips is not limited. For example, the NFC chip 210 may be connected to the left side of the circuit board 100, and the ADC chip 220 may be connected to the right side. Or other types of function modules may also be connected. The connection mode may be the left side, the right side or two side edge of the circuit board.

For example, the function modules may also include devices such as flash memory cards, so as to realize the function of the above program burning module.

It should be noted that the SOC 10 mounted on the back of the strip display screen 20 in the embodiment of the present disclosure is not limited to the specific structure of the SOC 10 as illustrated in FIGS. 6 and 9, as long as the interfaces, the circuits and the modules in the circuit board 100 all satisfy the setting requirements in the embodiment of the present disclosure, and the SOC that can be adapted to the strip display screen 20 can all be applied to the strip display apparatus provided by the embodiment of the present disclosure, and achieve the technical effect which is the same with that of the display control system provided by the above embodiment.

What is claimed is:

1. A display control system, comprising:

a circuit board comprising a top edge, a bottom edge opposite to the top edge, and a side edge intersecting with the top edge and the bottom edge, wherein both a length of the top edge and a length of the bottom edge are larger than a length of the side edge;

a core module disposed on the circuit board and configured to process display information;

an image data output interface on the circuit board, connected with the core module, and configured to output display image data; and a plurality of function modules on the circuit board, connected with the core module, and configured to transmit the display information to the core module, wherein the plurality of function modules and the core module are arranged along an extension direction of the top edge, and the image data output interface is on a side, close to the bottom edge, of the plurality of function modules.

2. The display control system according to claim 1, wherein a width of the core module in an extension direction of the side edge is larger than a width of each function module of the plurality of function modules in the extension direction of the side edge;

along the extension direction of the top edge, the core module is on a side of the plurality of function modules, and the image data output interface is on a side, close to the plurality of function modules, of the core module, or, along the extension direction of the top edge, the core module is between any two adjacent function modules of the plurality of function modules, and the image data output interface is on a side of the core module.

3. The display control system according to claim 1 or 2, wherein no module is between the bottom edge and an edge, close to the bottom edge, of the image data output interface.

4. The display control system according to claim 1, wherein the plurality of function modules comprise:

an image transmission network module configured to transmit image information to the core module;

a guide module configured to guide the core module to read data; and a program burning module configured to load an operation system to the core module.

5. The display control system according to claim 4, wherein the core module comprises a core circuit; the image transmission network module comprises an Ethernet circuit, and the guide module comprises a guide circuit.

6. The display control system according to claim 5, wherein the plurality of function modules further comprise:

a power module configured to supply power for the display control system; and the display control system further comprises:

a power interface between the power module and the bottom edge of the circuit board; and an Ethernet interface between the Ethernet circuit and the bottom edge of the circuit board, wherein no module is between the power interface and the bottom edge of the circuit board, and no module is between the Ethernet interface and the bottom edge of the circuit board.

7. The display control system according to claim 6, wherein the power interface and the Ethernet interface are upright interfaces.

8. The display control system according to claim 5, wherein the power module and the Ethernet circuit are adjacent to each other, and the display control system comprises:

one of a controller area network (CAN) bus interface and a power over Ethernet (POE) interface which is disposed between the power module and the Ethernet circuit and the bottom edge of the circuit board and is connected with the power module and the Ethernet circuit, no module is arranged between the CAN bus interface and the bottom edge of the circuit board or no module is arranged between the POE interface and the bottom edge of the circuit board.

9. The display control system according to claim 1, further comprising:

a wireless fidelity (WIFI) module on a side, close to the bottom, of at least a part of function modules of the plurality of function modules, and comprising an antenna terminal, wherein the antenna terminal is close to the bottom edge.

10. The display control system according to claim 1, wherein the side edge comprises a first side edge and a second side edge which are opposite to each other, and the display control system further comprises:

an interface which is arranged along at least one selected from a group consisting of the first side edge and the second side edge and comprises at least one selected from a group consisting of a voltage interface, a serial peripheral interface (SPI), an internal integrated circuit bus (IIC) interface, a serial interface and a universal serial bus (USB) interface.

11. The display control system according to claim 10, wherein the USB interface comprises at least one selected from a group consisting of a USB On-The-Go (USB OTG) and a USB HOST.

12. The display control system according to claim 10, comprising a plurality of voltage interfaces, wherein the voltage interfaces are arranged along both the first side edge and the second side edge, and at least one selected from a group consisting of the SPI interface and the IIC interface is arranged along both the first side edge and the second side edge.

13. The display control system according to claim 10, wherein the voltage interface, the SPI, the IIC interface and the serial interface are sequentially arranged along the first side edge of the circuit board, and the USB OTG, the USB HOST, the SPI and the voltage interface are sequentially arranged along the second side edge of the circuit board.

14. The display control system according to claim 10, wherein the interfaces satisfy one or more of the following modes:

all the voltage interface, the SPI, the IIC interface and the serial interface adopt horizontal patch pin header; and the serial interface is in a transistor-transistor logic (TTL) mode.

15. The display control system according to claim 1, further comprising:

at least one selected from a group consisting of a near field communication (NFC) module, an analog-to-digital conversion (ADC) module and a high definition multimedia interface (HDMI), arranged along the extension direction of the top edge with the plurality of function modules.

16. The display control system according to claim 15, wherein the display control system comprises a program burning module and a WIFI module, along the extension direction of the top edge, the power module, the Ethernet circuit, the guide module, the program burning module, the HDMI and the core module are sequentially arranged, the image data output interface is between the WIFI module and the core module, and the WIFI module is between the guide circuit and the bottom edge of the circuit board.

17. The display control system according to claim 1, wherein a center line of a length of the image data output interface in the extension direction of the top edge overlaps with a center line of the top edge, or, the center line of the length of the image data output interface in the extension direction of the top edge is within a deviation threshold away from the center line of the top edge on two sides of the center line of the top edge along the extension direction of the top edge.

18. The display control system according to claim 1, wherein a length of the top edge is eight times the length of the side edge.

19. A display apparatus, comprising:

a strip display screen comprising an image data input interface; and the display control system according to claim 1, wherein the display control system is on a non-display side of the strip display screen, and the image data output interface of the display control system is connected with an image data input interface of the strip display screen.

20. The display apparatus according to claim 19, wherein an orthographic projection of a center of the image data output interface of the display control system on the circuit board coincides with an orthographic projection of a center of the image data input interface of the strip display screen on the circuit board.

* * * * *